428-919 SR
3/18/86 XR 4,576,904

United States Patent [19]
Anitole

[11] Patent Number: 4,576,904
[45] Date of Patent: Mar. 18, 1986

[54] METHOD FOR DEVELOPING NATURAL CAMOUFLAGE PATTERNS

[75] Inventor: George Anitole, Arlington, Va.

[73] Assignee: The United States of America as represented by the Secretary of the Army, Washington, D.C.

[21] Appl. No.: 749,854

[22] Filed: Jun. 28, 1985

Related U.S. Application Data

[63] Continuation-in-part of Ser. No. 527,532, Aug. 29, 1983, abandoned.

[51] Int. Cl.[4] ..... G03C 5/00
[52] U.S. Cl. ..... 430/347; 428/919; 355/18; 355/78; 354/75; 354/76; 430/394; 430/396; 430/644; 430/928; 430/951
[58] Field of Search ..... 428/919; 355/20, 18, 355/78; 354/75, 76; 244/1; 89/36 R; 430/347, 394, 644, 928, 951, 396

[56] References Cited

U.S. PATENT DOCUMENTS

| | | | |
|---|---|---|---|
| D. 263,637 | 3/1982 | Fobes | D92/1 R |
| D. 265,774 | 8/1982 | Crumley | D92/1 R |
| 1,139,642 | 5/1915 | Cox | 428/919 |
| 3,698,906 | 10/1972 | Kelly | 430/394 |
| 3,900,706 | 8/1975 | Lemelson | 358/102 |
| 3,934,081 | 1/1976 | Schumacher | 355/20 |
| 3,967,026 | 6/1976 | Dalblom | 428/919 |
| 4,202,662 | 5/1980 | Boucher et al. | 8/444 |

FOREIGN PATENT DOCUMENTS

| | | | |
|---|---|---|---|
| 556235 | 8/1932 | Fed. Rep. of Germany | 428/919 |

*Primary Examiner*—Mary F. Downey
*Attorney, Agent, or Firm*—John E. Becker; Anthony T. Lane; Robert P. Gibson

[57] ABSTRACT

More effective camouflage patterns are generated by use of certain known photographic and photooptical contrasting procedures to obtain more desirable positive high contrast images representative of the natural background areas in which military equipment is intended to operate. Generating and using such camouflage patterns constitute a unique and novel use of such images which have predetermined color tones or values assigned to varying degrees of light, intermediate and dark contrast areas. The patterns may be applied onto the equipment in any of several conventionally known manners, thereby enabling otherwise artistically unskilled field soldiers to more effectively camouflage their equipment.

12 Claims, 5 Drawing Figures

METHOD FOR DEVELOPING NATURAL CAMOUFLAGE PATTERNS

GOVERNMENT INTEREST

The invention described herein may be manufactured, used and licensed by or for the Government for Governmental purposes without the payment to me of any royalties thereon. The parent application has been assigned to the U.S. Government, as will be this one.

This is a continuation-in-part of application Ser. No. 06/527,532 filed Aug. 29, 1983, now abandoned.

BACKGROUND OF THE INVENTION

The prior art of camouflage patterns for tactical military equipment and clothing was based on an artistic and subjective determination of geometric shapes intended to conceal identifying characteristics such as shape, shadow, highlights, and the horizontal, vertical, and circular lines which often distinguish manmade items from natural terrain and foliage. Often similar camouflage patterns have been used for widely differing environments for example for arctic and desert locations using the same basic patterns with only color changes to accommodate the different conditions. The basic guidelines in developing these patterns are to avoid designs which show up as the aforesaid vertical, horizontal and circular or as parallel, plaid or zebra type patterns. Heretofore there have been no significant attempts to relate the pattern to the natural shapes and shadows encountered in the different natural backgrounds against which the tactical military equipment is to operate. The development of such patterns has been a continuing empirical effort among NATO countries until the presently developed technique.

Therefore it has become apparent of the need for a novel technique for more scientifically generating camouflage patterns which more nearly resemble the natural background patterns and thus reduce the detectability of the equipment and/or tents and clothing which has been patterned according to this technique. The selected technique involves generating these natural patterns by photographic techniques. Therefore this invention will make it possible to more easily tailor these camouflage patterns to a variety of different tactical environments, based on a photographic process of adjusting the contrast of background photographs to the point where contrast patterns are recognizable, then adopting the contrast patterns usually in two or three color patterns such as in black, light green and forest green, as will be more specifically described hereinafter.

BRIEF SUMMARY AND OBJECTS OF THE INVENTION

The concept of this invention involves a method for generating natural camouflage patterns which are similar to the major contrast highlights found in the natural backgrounds in which tactical military equipment is to operate. Contrast highlights can be obtained by various means and techniques. For example, a new photograph can be taken of the background, or a file photo of terrain in which military operations are contemplated can be obtained, and either of these photographs can be photographically processed to yield a positive or negative image which can be selectively used to generate the camouflage pattern. Although either a positive or negative image may be used from which to work up the selected camouflage pattern, usually it will be easier for lay personnel to work with positive images. The technique of taking the initial photograph includes providing suitable means to establish a discernable distance scale on the photograph along the area of the selected background environment. This may include the placement of observable markers at predetermined measured intervals laterally along the selected background from which a potential camouflage pattern is expected to be chosen. In general, camouflage patterns for use on tents or clothing and for use on the vertical surfaces of military equipment would be generated by ths use of terrain photographs taken from the surface, while the upper surfaces of the equipment, which are normally only visible from the air, may be camouflaged either with the same or slightly different patterns generated by this technique from aerial photos of the same terrain and foliage. The evolved photographic technique makes it possible to more readily tailor environments by adjusting the contrast of various selected background photographs to the point where only the more bold contrast highlights remain after the minor contrast highlights and fine tone details drop out, then coloring the selected pattern in two or three colors as will be further described hereinafter. In this way the equipment can be effectively concealed from both ground and air surveillance.

In the discussions herein, the bold contrast highlights are deemed to be representative of larger areas of close or near identical degrees of light reflectivity, and the minor highlights or fine details are considered to be the much smaller areas of the same degree of light reflectivity.

It is thus an object of the invention to provide a novel method of photographically generating natural camouflage patterns which are adapted for different types of natural backgrounds in which tactical military equipment may operate.

Another object of the invention is to provide military equipment with different camouflage patterns as aforesaid for the sides or vertical surfaces thereof and for the top or upper surfaces thereof, whereby the equipment will be effectively camouflaged from both ground and aerial observation.

A still further object is to provide a more scientific method of generating natural camouflage patterns by utilizing actual photographs of natural backgrounds such as terrain and foliage, and then processing such photos to adjust the contrast thereof to a point where high contrast patterns analogous to those contrast highlights found in natural foliated backgrounds are evident, and then utilizing preselected portions of such high contrast patterns as the camouflage pattern for tactical military equipment and/or clothing.

These and other objects and advantages for the invention will become more apparent from the following detailed description and the drawings.

DETAILED DESCRIPTION OF A PREFERRED EMBODIMENT

The first phase of the technique is to photograph, preferably in both color and in black and white, a series of selected mixed coniferous and deciduous woodland background areas from preferably both ground and airborne positions. It is understood that the term photograph as used throughout this specification is to include images formed either as transparencies or as paper prints, and may include negative images.

Figure 1:
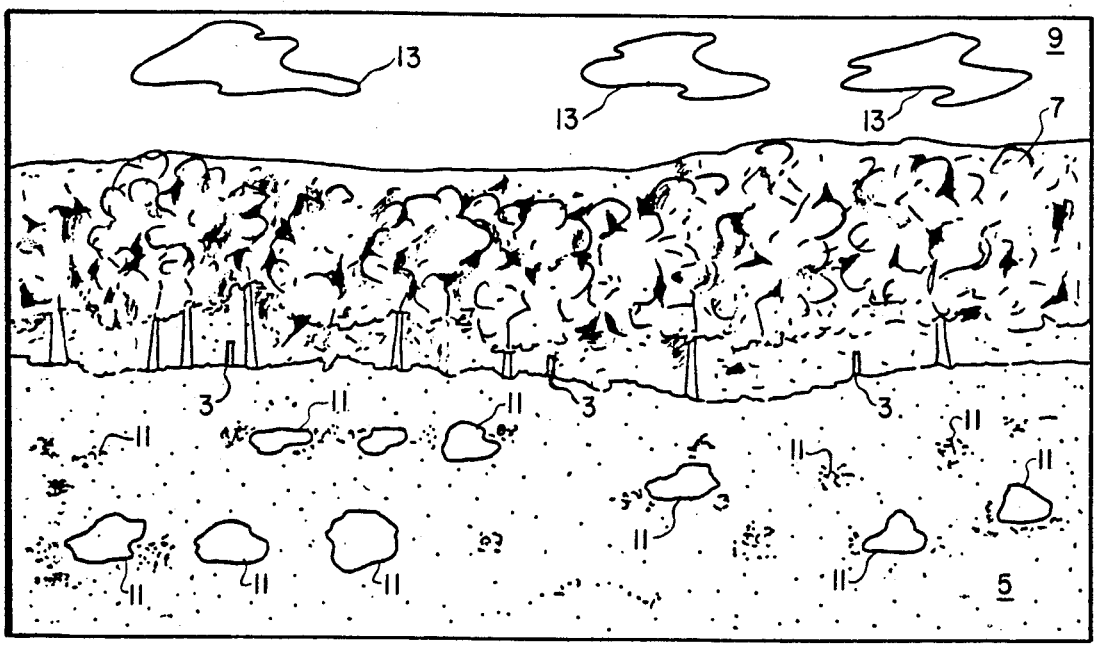
FIG. 1 is a drawing representative of a black and white positive photograph depicting a background treeline which can be used to create a natural camouflage pattern.

FIG. 1 is a representative of a black and white postive photograph of a stand of trees 7 in the distance with a relatively flat field 5 in the foreground. Several scattered small bushes, weeds and rocks 11 are shown in the field. A series of generally uniformly spaced apart markers 3 spaced at predetermined lateral distances such as twenty feet apart, are necessary to provide a relative distance scale. The bright sky 9 is visible above the stand of trees 7 with three scattered clouds 13 therein. It can be seen in this representative photograph that the treeline consists of black and white areas with various shades of grey. For example, the tree area 7 comprises mostly dark grey or black areas with smaller areas of white of light grey distributed therethrough. The light areas of FIG. 1 represent light reflection from the trunks, branches and foliage thereon, and the darker areas represent shadows. One camouflage pattern development procedure uses a series of negative and positive image generations of the selected wooded background. A first positive photographic image which includes all the contrast levels of the original scene and related basic detail may be made as from a negative using a standard Panchromatic tone film, resulting in the positive photograph such as depicted in FIG. 1. Next, at least one more generation of negative or positive is made, depending upon the process used, which shows an increased loss of detail while leaving the high contrast of the trees area. The process may involve two or three or more steps of making either negative and/or positive images or photographs which progressively remove unwanted background detail while generating potentially useable major high contrast areas.

Figure 4:
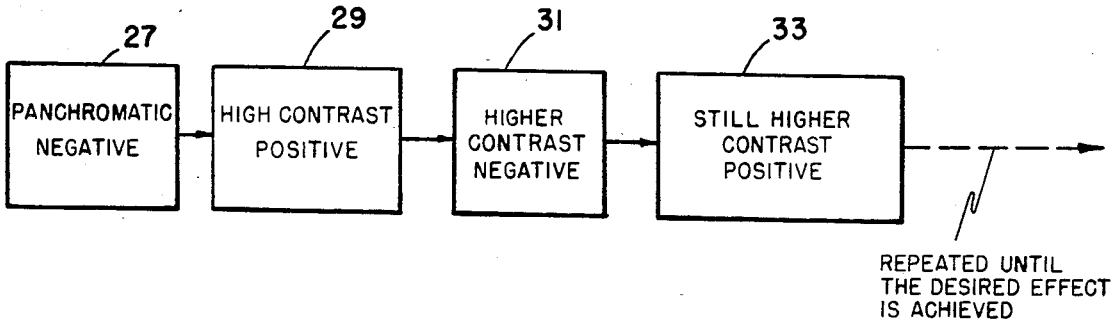
FIG. 4 illustrates a block diagram of one photographic process which can be used in the practice of the present invention.

One known method is to start with a standard Panchromatic or equivalent black and white tone film, which is not a particularly high contrast type of film, and which will produce various tones of grey in addition to black and white tones. Using this negative, which is the camera original or first generation image, a first positive is made, preferably using high contrast paper. Another negative image is made by rephotographing the first positive photograph using a film which preferably is of higher contrast than the original Panchromatic film. The second negative is then printed into a subsequent positive photograph, again preferably using the higher contrast film. In the absence of using the higher contrast film, it may require a higher number of repetitive sequences to produce the same result if a continuous tone film were used, all in a known mamner. This procedure desirably usually results in progressive loss of intermediate tones and less contrasting details until a desired level of contrast is obtained in either positive or negative form. It is preferably to use positive form images in the final step or image to avoid the necessity of having to mentally reverse black and white tones which occur in use of negative images. The aforedescribed procedure is one frequently called the copy camera process as diagrammically depicted in FIG. 4.

Another known process involves use of a type of high contrast so-called line copy film of negative or positive type which inherently produces either a negative or positive image which already has eliminated much if not all of the mid-tones other than black. By selecting line copy film of either positive or negative character, higher contrast images can be produced much more quickly with fewer or possibly no intermediate steps of progressively producing negative-positive-negative-positive images to arrive at a predetermined level of high contrast background images to serve the basis of the desired camouflage pattern.

However, caution should be exercised in following this procedure because too drastic a drop of the intermediate or midlevel tones could occur beyond the desired level of contrast needed to serve as the basis of the camouflage pattern.

One commercially available camera machine for achieving at least some of the aforesaid results is known as the ITEK Model 430 Camera Processor manufactured by ITEK Graphic Products Division of the ITEK Corp of Rochester, N.Y. This machine is capable of producing either a positive or negative initial image transparency, from an original positive photograph or negative, again depending upon whether a negative or positive type film is used in the machine. Thus the final useable image from which the camouflage pattern may be selected can be in either positive or negative form. The positive form is preferred in all instances because it is usually much easier for the user in that it does not require mentally reversing the dark and light areas of the film when transposing to compose the camouflage patterns.

The final high contrast images or areas are then further examined and evaluated to determine and select a good representative area showing an average blend of the black and white areas on the film. A selected portion of the black and white or clear areas such as shown the encircled area in FIG. 2 is chosen to form the basic silhouette shapes to be used in the camouflage pattern for equipment and/or clothing to be used in areas with foliage like that depicted in FIG. 1.

Figure 2:
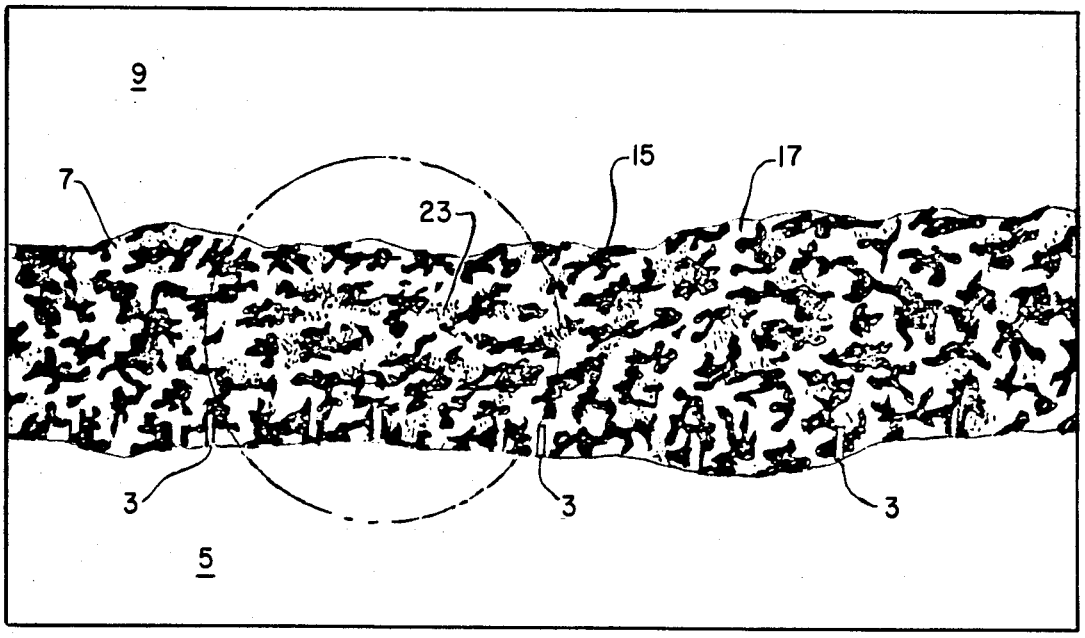
FIG. 2 is a representative of the further processed positive photograph of FIG. 1, showing the bold contrast highlights of a positive image which can be used to form a camouflage pattern.

FIG. 2 shows how the treeline of FIG. 1 has been converted into a silhouette-like pattern simply by interim steps of having progressively increased the contrast between the light and dark areas thereof so that all of the areas darker than a certain density will be converted to black and all areas lighter than this density value will be converted to white, that is, the intermediate grey tones will have dropped out. The black areas of FIG. 2 are represented by numeral 15 and the light areas by 17. Such silhouette-like patterns as those described can be produced by any one of several known photographic techniques as previously described. It should be noted that in FIG. 2 the image of the foreground and the sky is not of interest and has been omitted.

In some cases it is desirable to generate a pattern by this technique which includes three density levels or shades and to color these three shades with different colors to simulate the colors of the natural foliage. These three density levels sometimes occur naturally in early generation images which can be adopted for such a pattern. The third density level is shown by the stipled areas 23 in FIG. 2. These would be considered grey areas which would be represented by a third color shade as will be described later.

A scale outline drawing is then made of the vehicle, article, or building to be camouflaged. Usually five views are made representative of both sides, front, rear and top. The outlines of the selected area black and white pattern portions which have been selected to form the camouflage patterns are then suitably enlarged, as by a photographic or some standard drafting or hand sketching technique, to a scale which fits the scale of the outline drawings of the vehicle/building/articles to be camouflaged, using the aide of the aforesaid markers 3. One such known drafting technique includes use of Expandograph type equipment used to enlarge small scale drawings into various size larger scale drawings, and vice versa. These selected patterns are then traced or otherwise suitably applied onto the five views (four elevations and one plan view) of the scale outline drawings to establish the completed camouflage pattern for the respective types of equipment. Using these drawings as masters, other copies can be reproduced for use by the personnel applying the camouflage patterns onto the equipment. From the outlines, the various black and white pattern areas are then hand sketched or otherwise suitably transferred onto the actual vehicle or equipment, at the appropriate full scale. When sketching the pattern outline upon the equipment by hand, parts and projections of the equipment, which are descernable on the outline drawings, can be used as a guide to help maintain or correlate the pattern scale. The pattern may be repeated after covering predetermined areas or for different views of the equipment. The selected pattern also can be made into a transparency for photo-optical projection onto the equipment at the proper scale by any suitable commercial projector equipment. The outline of the pattern is then traced by hand onto the equipment, such as with chalk, brush or fine spray all preferably in the appropriate color. Additionally it is contemplated that full size stencil patterns can be prepared from which to apply the pattern, although in some circumstances this may prove somewhat unwieldly. The colors for the black and white areas are determined by studying the original color and black and white photos of the area. Thus, the hightlights in a summertime wooded background would preferably be light green and black. For desired three contrast areas an intermediate color such as forest green may be used to represent intermediate smaller highlight areas, such as represented by the stipled area 23 in FIG. 2, the same reference number 23 being used to designate the corresponding intermediate or third tone area in FIG. 3. The colors are then applied to the pattern outlines as by brush or spray gun, the latter of which may include the use of robotic means.

By taking color photographs of the area initially, a true reference source of the background colors is available from which to select the pattern colors. This avoids the necessity to rely upon memory or other reference materials which may not be as accurate.

Figure 3:
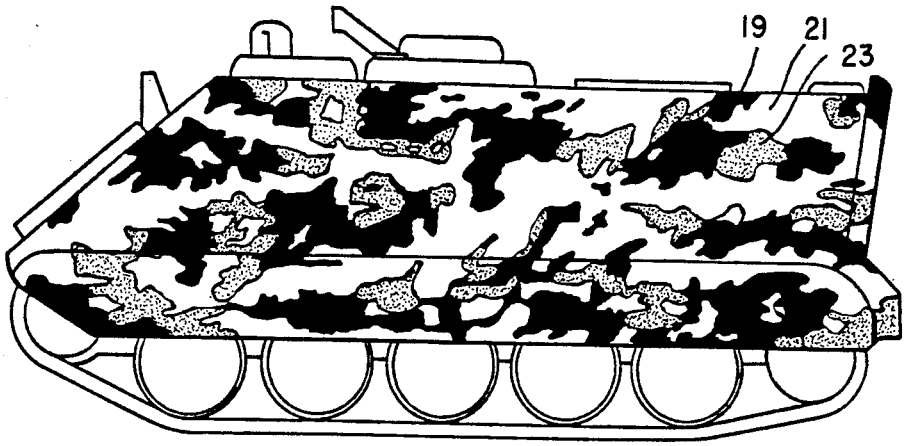
FIG. 3 shows a representative enlarged camouflage pattern as applied to the side of a military vehicle, which pattern was selected from the representative encircled area of FIG. 2 and which contains an average blend of dark and light areas.

FIG. 3 shows an armored personnel carrier which has its side camouflaged with a three color natural pattern generated according to the present invention. The most dense area is represented by numeral 19, the least dense by 21 and the intermediate density is represented by numeral 23. The intermediate density areas may comprise areas of mottled light and dark areas comprising small closely spaced light and dark areas depicted by said stipled area 23 in both FIG. 2 and FIG. 3.

From analysis of color photographs of woodland foliage it has been frequently determined that three colors are usually predominant, with light green and black about equally divided and constituting about 40% each, with the remaining 20% constituting forest or dark green. For most effective camouflage it has been found that the most dense area 19 as per FIG. 3 should be colored black, the least dense area 21 should be light green, and the mottled or intermediate density area 23 should be forest green.

Although the pattern depicted in FIG. 3 shows three density levels, in many instances it may be preferred that the image or pattern really comprise only two density values or color tones. Therefore, a silhouette type pattern of two density levels should be colored black and light green. It is contemplated that a basic two color design of black and light green will generally suffice for most woodland backgrounds.

It should also be noted that the distance from which the photographs of areas are made should be within a range preferably of from about 200–300 yards without use of a telephoto lens. This also may become somewhat dependent upon the sparsity of the background environment. The distance limitation is relevant so as to avoid losing the bolder contrast highlights which will disappear with excessive distance.

If it is not possible to take a new photograph of the area in which the camouflaged equipment is to operate, for example if the operation is to be staged in a hostile or remote area, a file photograph of that area or a similar area can be obtained and processed as explained above. Where use of a file photograph is necessary, some estimate has to be made using some portion of the photographed background from which to establish a lateral distance scale from which to evolve the appropriate scaled camouflage pattern. Having established such lateral distance scale, suitable indicia representative of that scale can be applied to the photo.

When the high contrast effect is derived from a positive image, as previously stated, the white areas will be colored light green and the dark areas will be colored black. Any mottled or stipled areas would be colored forest green. However, the desired high contrast effect may sometimes be achieved at a stage of a negative image in the processing of the photo. If this is the case, then the dark areas thereof would be colored light green, the white areas would be black and the mottled areas would be made forest green, because of the density reversals of such a negative.

Although it has been found that a pattern evolved from ground level photos has been successfully used as a camouflage pattern for portions of equipment viewed from higher elevations and from the air, there may be times when aerial photos will be preferred to be used to generate patterns to be applied to the portions of the equipment visible from the air only. Normally clothing is visible in detail only from the surface and surface photos would normally be used to generate clothing patterns such as the familiar jungle fatigues worn by US Army and Marine Corps personnel. As a practical matter, an oblique aerial photo represents features of both surface and aerial photos and can be used to generate a single pattern for use on the sides and tops of vehicles, and buildings.

Field tests conducted with four other types of foreign and domestic patterns indicated that a vehicle painted with applicant-inventor's new system-derived camouflage pattern has an average detection range of about 175 meters as compared to its nearest competitive pattern which was found to have a detection range of about 250 meters.

It is contemplated that the selected patterns may also be generated electronically or photo-optically, for example, by a known process of making a video tape recording or movie film of the natural background, replaying the tape or film, stopping the tape or film at a desired place or frame on the video receiver's or other optical screen and then simply turning up the mechanism's contrast control until the desired high contrast pattern appears. A snapshot can be taken of the screen for use in reproducing the pattern, or some hand tracing onto a separate sheet, or even the side of a piece of equipment, if used as a screen onto which the scene is projected, may be achieved.

Figure 5:
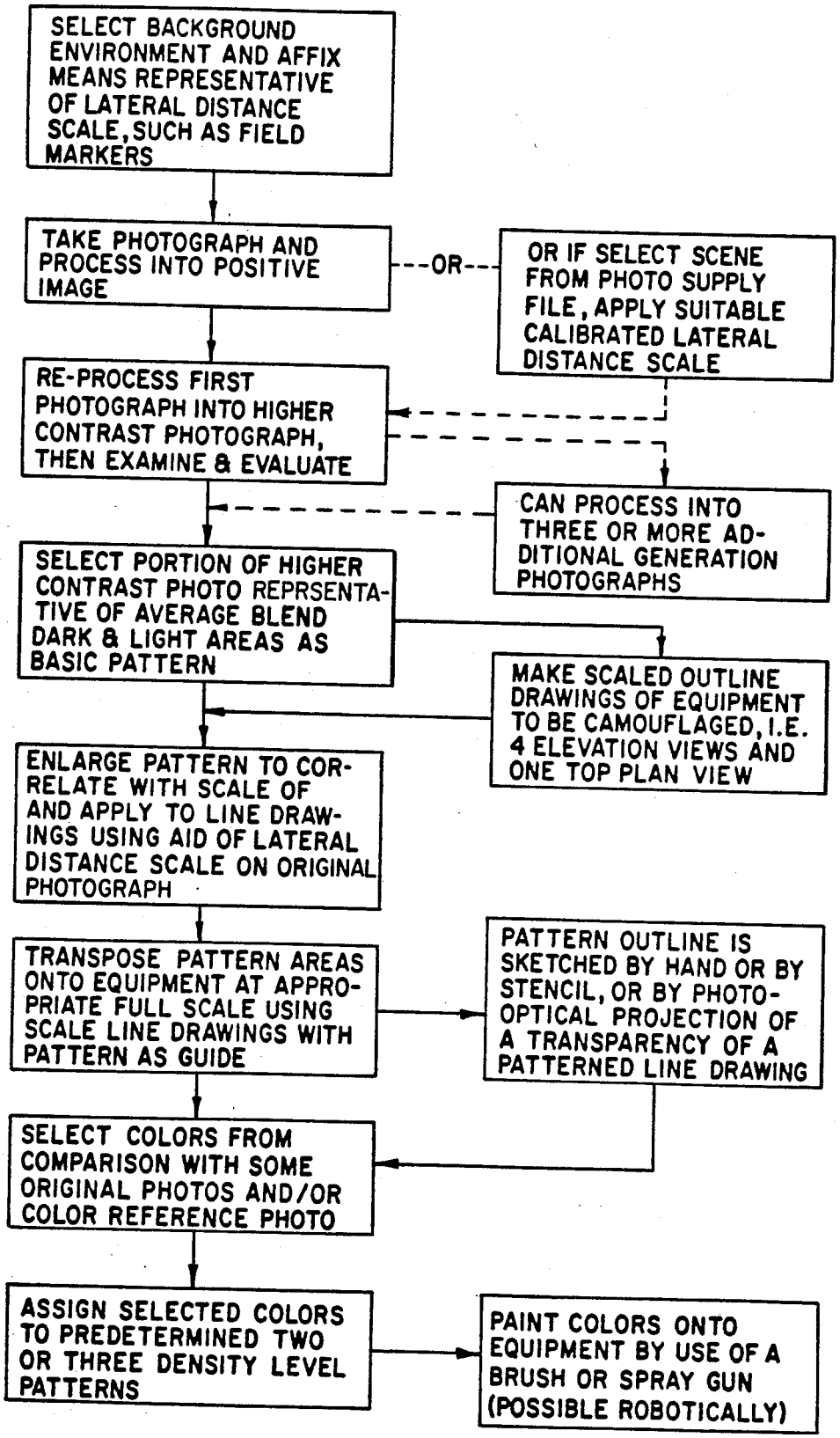
FIG. 5 is a block diagram representative of the inventive method hereof.

FIG. 5 is representative of the procedural steps involved in carrying out the present invention. The procedures are believed self-evident from the foregoing description and need not be repeated here.

It is further understood that the discussion concerning representative colors are illustrative and that the colors or color tones will vary according to the climatic areas and seasonal changes.

While the invention has been described in connection with illustrative embodiments, obvious variations therein will occur to those skilled in the art, accordingly the invention should be limited only by the scope of the appended claims.

What is claimed is:

1. A method for more scientifically generating more natural camouflage patterns, comprising the steps of:

(a) selecting for photographing a natural environmental background area site, of the type in which military equipment and personnel are expected to operate;

(b) providing means for establishing a known lateral distance scale so that it will appear in conjunction with a resulting negative or positive film across the area photographed;

(c) photographing the selected area background and processing to obtain at least a first positive image photograph of the background area which photograph embodies all contrast tonal levels of the area;

(d) examining and evaluating said photograph to determine the potential acceptability of the various contrast tonal levels thereof in its initial form against a potential need to prepare any subsequent generation photographs to achieve bolder higher contrast tonal levels while eliminating certain lesser contrast tonal areas;

(e) selecting an area of said at least first positive image photograph's higher contrast pattern to be representative of an average blend of the predominately dark and light tonal areas to constitute the basic camouflage pattern, and enlarging this selected area pattern to a scaled up size into a form which will be compatibly adaptable for subsequent transfer onto the aforesaid military equipment;

(f) transposing at least in outline form the selected higher contrast dark and light tonal areas of the selected pattern onto various equipment/materiel; and thereafter (g) applying at least two different color paints to said selected higher contrast dark and light areas which paint colors are deemed to provide the best camouflage effect as determined by a comparative evaluation with at least said initial photograph of said background environmental area site.

2. The method of claim 1, wherein step (c) further includes additional processing of the photographed area image so as to progressively obtain subsequent generation photographs with bolder contrast tonal highlights of the desired background, while simultaneously eliminating and reducing other minor tonal highlights or fine details, more particularly where the initial examination and evaluation dictates the potential need thereof.

3. The method of claim 1, further including producing a series of alternating negative and positive photographic images which contain progressively bolder higher contrast tonal levels.

4. The method of claim 1, wherein step (c) further includes photographing the selected area and adjacent areas with both color and black and white film so as to have a color photograph basis from which to select color for the camouflage pattern.

5. The method of claim 1, wherein step (e) further includes selecting an area of the photographed background site which also contains an average blend of intermediate or mottled tonal areas in combination with said predominately dark and light areas; and step (g) further includes applying at least three different color paints to the said three tonal areas.

6. The method of claim 1, wherein step (b) includes placing of visible marker means at known laterally spaced-apart distances across the background area to appear in the photograph.

7. The method of claim 1, wherein step (b) includes placing a lateral-distance-denoting-scale indicia means to appear in association with said photograph.

8. The method of claim 1, wherein step (f) further includes making appropriately scaled outline drawings of plural views of the equipment to be camouflaged so as to correlate with the enlarged area pattern, and transferring the enlarged area pattern onto the respective plural views of said drawings for intermediate use in said transposing step (f).

9. The method of claim 1, wherein the transposing step (f) includes using a transparent film with the pattern thereon and photo-optically projecting the outlined high contrast dark and light areas from the film transparency at appropriate scale onto areas of the military equipment to be camouflaged, and then manually applying the predetermined appropriate color camouflage paint to the respective areas.

10. The method of claim 1, wherein the transposing step (f) includes hand drawing at least a first master camouflage pattern of the selected camouflage pattern design on flexible sheet material and tracing or copying from said master pattern the respective dark and light high contrast areas onto different sides areas of the equipment to be camouflaged.

11. The method of claim 1, therein the transposing step (f) includes preparing the camouflage patterns in a stencil or stencil-like form.

12. The method of claim 1, wherein step (c) includes using photographing procedures and equipment to produce at least one negative image photograph from which to conduct the examining and evaluating step (d).

* * * * *